United States Patent [19]

Buchanan

[11] Patent Number: 4,821,810

[45] Date of Patent: Apr. 18, 1989

[54] AGRICULTURAL AND CONSTRUCTION UTILITY BLADE

[76] Inventor: Vernon R. Buchanan, R.R. #3, Box 145, Pawnee, Okla. 74058

[21] Appl. No.: 193,388

[22] Filed: May 12, 1988

[51] Int. Cl.[4] ..... E02F 3/815

[52] U.S. Cl. ..... 172/197; 172/445.2; 172/448

[58] Field of Search ..... 172/445.1, 445.2, 459, 172/448, 197

[56] References Cited

U.S. PATENT DOCUMENTS

| | | | |
|---|---|---|---|
| 2,493,565 | 1/1950 | Arps | 172/445.2 |
| 2,560,711 | 7/1951 | Arps | 172/445.2 |
| 2,710,467 | 6/1955 | Cundiff | 172/445.2 |
| 2,723,472 | 11/1955 | Bartlett | 172/445.2 |
| 2,762,140 | 9/1956 | Elfes | 172/448 |
| 2,822,628 | 2/1958 | Arps | 172/445.2 |
| 3,324,955 | 6/1967 | Perold | 172/197 X |
| 3,566,547 | 9/1951 | Bartlett | 172/445.2 |
| 3,797,582 | 3/1972 | Couch | 172/445.2 |
| 4,061,194 | 12/1977 | McCanse | 172/445.2 |
| 4,337,833 | 7/1982 | Welch | 172/445.1 |

*Primary Examiner*—Richard J. Johnson

*Attorney, Agent, or Firm*—Laney, Dougherty, Hessin & Beavers

[57] ABSTRACT

The utility blade assembly for use on tractors having a three-point hitch connection. The blade assembly includes an elongated boom having a turntable mounted on the rear end thereof. The turntable carries a utility blade. Hydraulic piston and cylinder subassemblies are provided for rotating the blade on the turntable. At its forward end, the boom extends through a sleeve in which it is free to rotate about its axis. The sleeve carries aligned laterally projecting elements which function to support the sleeve and boom for rotation about a transversely extending horizontal axis. A piston and cylinder subassembly is provided for pivoting the boom and sleeve about this horizontal axis so that the rear end of the boom carrying the turntable and utility blade can be lifted upwardly. A boom rotating piston and cylinder subassembly is provided for rotating the boom about its longitudinal axis.

24 Claims, 3 Drawing Sheets

AGRICULTURAL AND CONSTRUCTION UTILITY BLADE

BACKGROUND OF THE INVENTION

1. Field of the Invention

This invention relates to scraper and grader blades of the type which are termed utility blades, and which are adapted for connection behind, and operation from, three-point tractor hitch connections conventionally carried on tractors such as farm tractors.

2. Brief Description of the Present Invention

This invention is a utility blade which can be quickly and easily shifted or moved to a selected one of a plurality of operating positions, and which is carried at the rear of, and connected to, a tractor having a three-point hitch for connection of tilling tools and implements.

The utility blade of the invention includes an elongated beam having a forward end and a rear end. The forward end portion projects through a sleeve having a pair of lateral arms projecting therefrom, and secured to the sleeve for rotation with the sleeve about the axis of the boom. The rear end of the boom carries the utility blade which is mounted on the end of the boom so that it can be selectively rotated about a vertical axis extending through a pivot pin projected through the boom and through a turntable upon which the blade is carried.

The lateral arms which project from opposite sides of the sleeve which receives the forward end of the boom are swively or rotatably mounted in a pair of collars. These collars are adapted to be connected to the two lower, outside clevises or couplings of the three-point connection of a conventional agricultural tractor. The central and uppermost connection of the three-point connection carries a first or boom lifting hydraulic piston and cylinder subassembly which extends rearwardly and inclines downwardly. One end of the piston and cylinder subassembly is connected to a clevis plate carried on a fixed annular band secured to the rear end of the sleeve through which the boom extends. This first piston and cylinder subassembly is used to elevate and lower the boom about a horizontal pivotal axis which is coaxial with the axis of the two horizontally aligned lateral arms which project from opposite sides of the sleeve.

One side of the sleeve which receives one end portion of the boom defines a relatively large slot so that a pair of clevis plates can be secured to the lower side of the boom at this location and project through the slot in the sleeve. This facilitates the connection to such clevis plates of one end of each of a pair of second hydraulic piston and cylinder subassemblies which project outwardly and rearwardly at an angle to the boom and have their opposite ends connected to the utility blade. These second piston and cylinder subassemblies function to selectively rotate the blade about a large pivot bolt projected through the rear end of the boom, and through the blade turntable, so as to afford a high degree of selectivity in the positioning of the blade during its utilization.

The turntable by which the utility blade is mounted to the outer or rear end of the boom includes an upper plate which is secured to, and movable with, the rear end of the boom, and a lower plate which is secured to, and pivotable with, the blade. An annular retainer ring is positioned around the outer periphery of the lower side of the lower plate and is held axially in place by a plurality of ring clamping fingers or hooks which are secured to the top plate, project around the outer periphery of the lower plate, and are then turned under for securement to the annular retainer ring. A plurality of pin apertures are provided in the lower plate. These are positioned on a radius with respect to the pivot bolt upon which the blade is pivotally mounted such that these apertures are aligned radially with four pairs of align d pin apertures in the top plate and in the retainer ring. As the blade undergoes rotation about the pivot bolt extending through the boom and through the turntable formed by the upper and lower plates and retainer ring, a status of alignment of the successive pin holes is achieved so that the blade can be selectively positioned, and then retained in the selected position by insertion of retainer pins through the aligned pin holes in a manner hereinafter described.

An important object of the present invention is to provide an agricultural or construction utility blade assembly which can be secured behind, and operated from, a tractor having a standard three-point hitch at the rear end thereof. The utility blade of the assembly can be elevated with respect to the ground, can be adjusted by means of optionally usable gauge wheels with respect to the depth to which the blade will be allowed to cut into the earth, and can be rotated about a horizontal axis so as to, in effect, stand the blade on one end for purposes of trenching, ditch digging and the like.

Another object of the present invention is to provide a utility blade assembly which is very versatile in the blade attitude which it can be made to assume during earth working operations.

A further object of the invention is to provide a utility blade assembly which can be used for agricultural or construction purposes, and which is very ruggedly built, and is constructed to permit it to have an extended operating life with little need for maintenance or repairs during such operating life.

Additional objects and advantages will become apparent from the following detailed description when the same is read in conjunction with the accompanying drawings which illustrate a preferred embodiment of the invention.

GENERAL DESCRIPTION OF THE DRAWINGS

DETAILED DESCRIPTION OF A PREFERRED EMBODIMENT OF THE INVENTION

Figure 1:
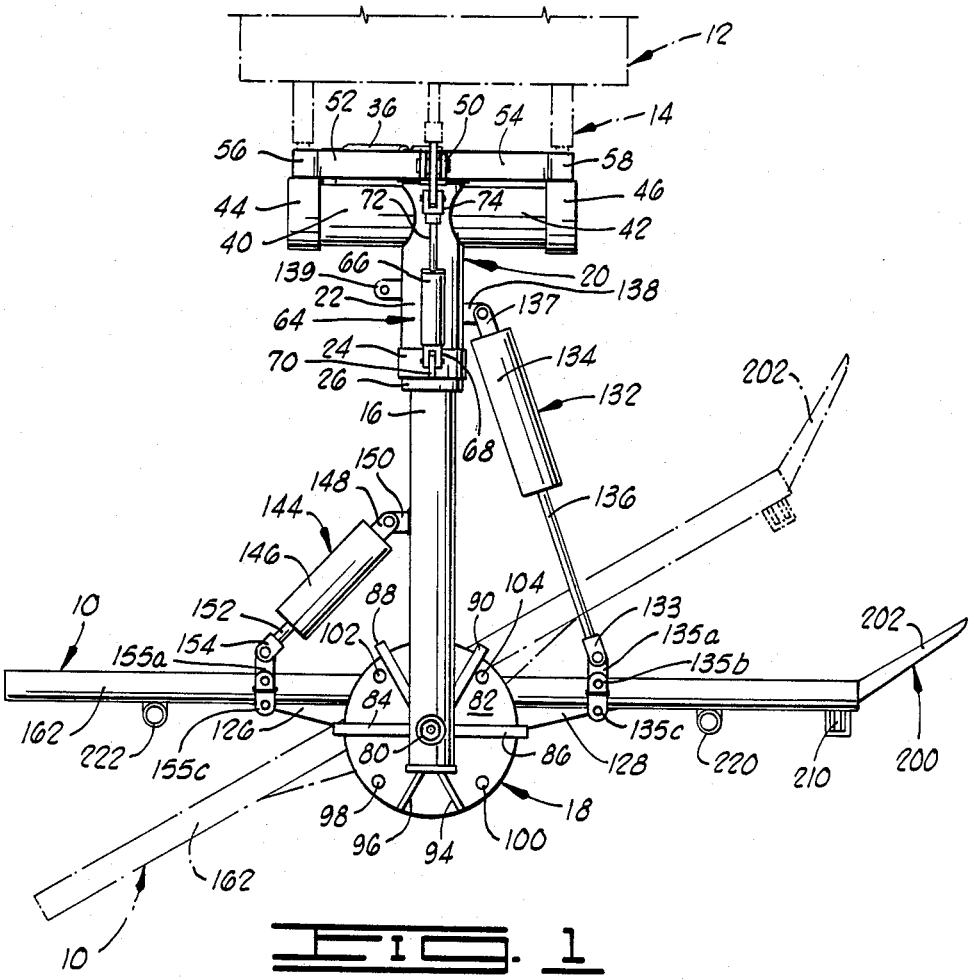
FIG. 1 is a plan view of the utility blade assembly of the invention. An alternate operating position of the utility blade is shown in dashed lines, and a portion of the tractor upon which the blade is mounted, showing particularly the three-point hitch connection, is also illustrated in dashed lines.
Figure 2:
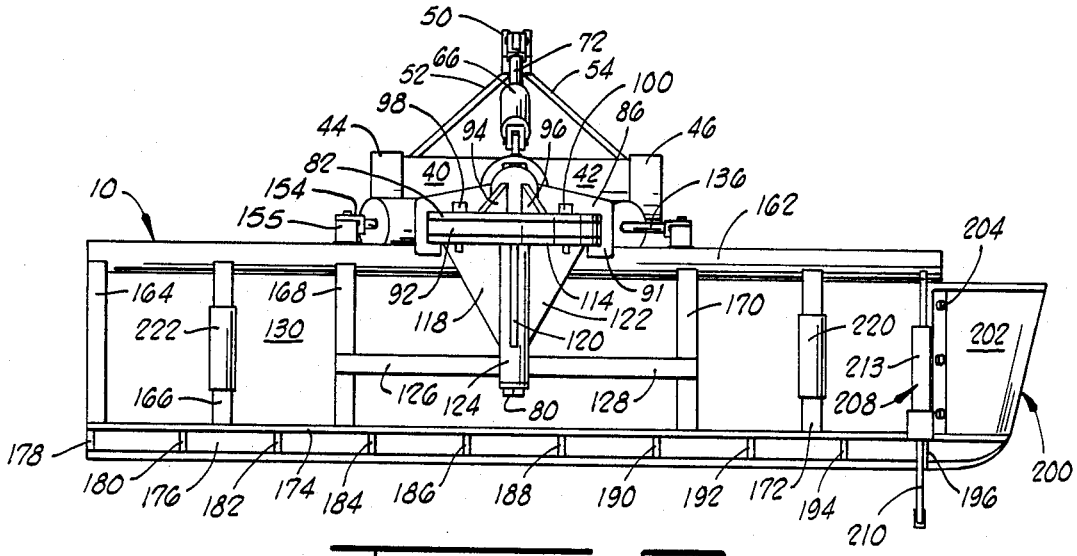
FIG. 2 is a rear elevation view of the utility blade assembly.
Figure 8:
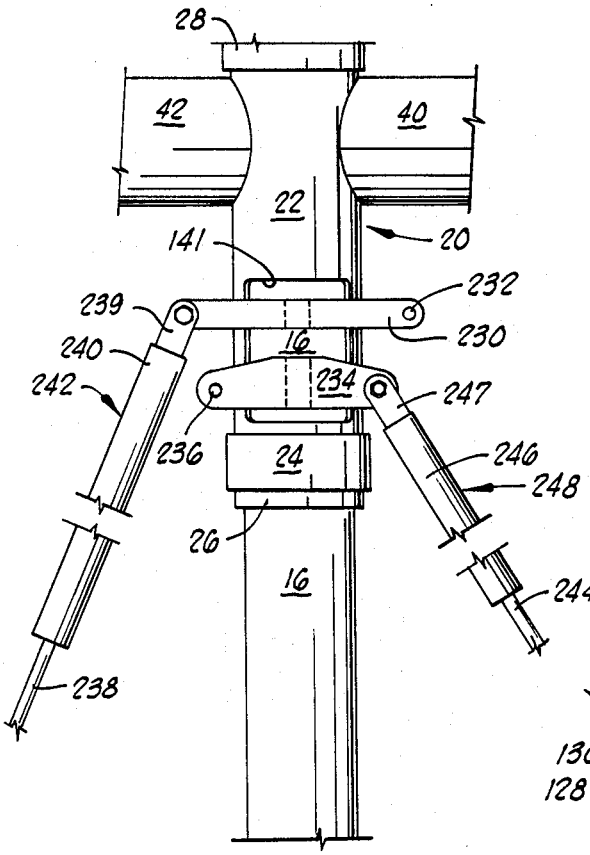
FIG. 8 is a bottom plan view of a part of the boom and sleeve utilized in an alternate embodiment of the invention.
Figure 10:
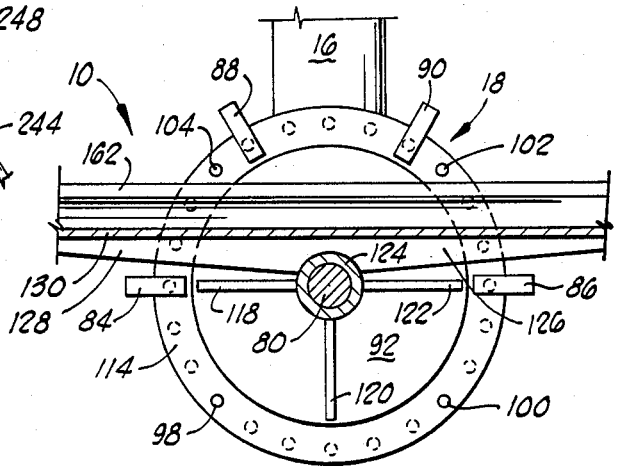
FIG. 10 is a sectional view taken along line 10—10 of FIG. 3.

Referring now to the drawings, and particularly to FIG. 1, the blade, per se, of the utility blade assembly of the invention, is denominated generally by reference numeral 10, and is shown in plan view in FIG. 1, and in rear elevation view in FIG. 2. The blade assembly, which includes the blade 10, is mounted to the rear of a tractor, designated generally by reference numeral 12, by means of a three-point hitch connection, designated generally by reference numeral 14. The utility blade assembly further includes an elongated boom 16 having a forward end, and having a rear end which is pivotally connected to the blade 10 through a turntable subassembly, designated generally by reference numeral 18. The forward end portion of the boom 16 projects through an elongated cylindrical sleeve subassembly 20. The sleeve subassembly 20 includes a cylindrical sleeve 22 which carries a concentric collar 24 at its rear end. The boom's movement axially in the sleeve is limited by a rear retainer ring 26 secured around the boom. The forward end of the boom 16 projects through, and ahead of the forward end of, the sleeve 22, and carries a forward retainer ring 28, as shown in FIGS. 4 and 8, also for the purpose of preventing axial movement of the boom 16 relative to the sleeve 22.

Figure 4:
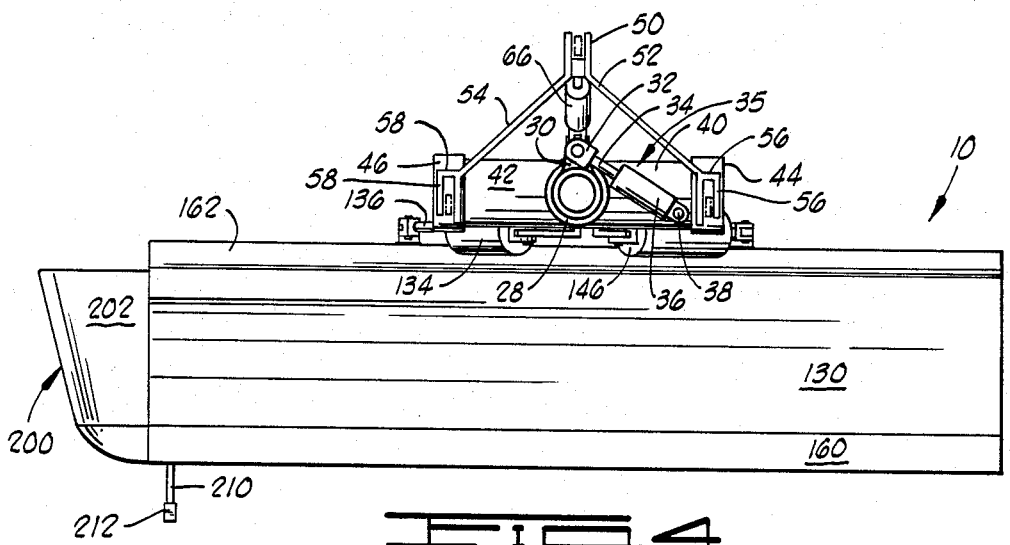
FIG. 4 is a front elevation view of the utility blade assembly.

For the purpose of causing the boom to undergo rotation within the sleeve 22 about the longitudinal axis of the boom, the forward end of the boom ahead of the forward ring 28 carries a radially projecting protuberant pivoting ear 30 (shown in FIG. 4). The pivoting ear 30 functions as a point of connection to the boom, through a U-shaped clevis bracket 32, of the piston rod 34 of a piston and cylinder subassembly 35 which also includes a cylinder 36. The piston and cylinder subassembly 35 has the piston bolted at 38 to a stationary portion of the inner connection of the three point hitch connection 14, and thus the entire subassembly undergoes lifting and lowering with the three-point hitch connection as such is effected from the hydraulic lift system of the tractor.

Projecting laterally from opposite sides of the cylindrical sleeve 22 are a pair of elongated tubular pivot arms 40 and 42. The pivot arms 40 and 42 are secured to the sleeve 22, and pivot with this sleeve about a horizontal axis which is colinear with the longitudinal axes of the elongated tubular arms 40 and 42. In order to allow the arms 40 and 42 to pivot in the outer connection elements of the three-point hitch connection 14, the arms 40 and 42 have their ends journaled in a pair of collars 44 and 46. Instead of this type of pivotal support, it is pointed out that the arms 40 and 42 could also have cylindrical stub axles or shafts extended into these arms and journaled therewithin so that the arms could pivot upon the internal stub shafts or axles.

In the illustrated embodiment, the three-point hitch connection is of fairly standard or conventional construction as such is generally found on tractors, such as agricultural tractors. The three-point hitch connection thus includes a top link 50 which is carried by, and supported at, the upper ends of a pair of rigid diagonal braces 52 and 54. At their lower and outer ends, each of the two diagonal braces 52 and 54 is connected to a U-shaped outer hitch link 56 or 58, as best illustrated in FIGS. 1 and 4. The outer hitch links 56 and 58, respectively, receive apertured connecting plates 60 and 62 which are welded to the forward side of the respective collars 44 and 46. The apertured connecting plates 60 and 62 can be connected to the three-point hitch connection by suitable pins or bolts extended through the apertures. In this way, the collars 44 and 46 are locked to the three-point hitch connection and cannot rotate about a horizontal axis, but are lifted upwardly, as is the entire utility blade assembly, at a time when the entire three-point hitch connection 14 is lifted upwardly by the tractor hydraulic system. The manner in which the outer links 56 and 58 and the central upper or top link 50 of the three-point hitch connection 14 are elevated by means of the hydraulic system of the tractor will be well understood by those skilled in the art.

In order to permit the boom 16 and the blade 10 connected thereto through the turntable 18 to be lifted or elevated upwardly a substantial amount relative to the earth, a boom lifting piston and cylinder subassembly 64 is provided. The boom lifting piston and cylinder subassembly 64 includes a cylinder 66 which is connected through a clevis bracket 68 to a clevis plate 70 which is welded to, and projects upwardly from, the concentric collar 24 carried at the rear end of the sleeve 22. The piston and cylinder subassembly 64 further includes an extensible piston rod 72 which carries a clevis bracket 74 at its upper and forward end. The clevis bracket 74 is pinned or bolted to a clevis plate 76 which projects into, and is pivotally connected by pinning or bolting to, the opposed parallel plates of the top link 50 of the three-point hitch connection 14 (see FIG. 3).

It will be perceived that by the use of the boom lifting piston and cylinder subassembly 64, the outer or rear end of the boom 16, which carries the turntable 18 and the blade 10, can be lifted upwardly from a horizontally extending position to an upwardly extending position in which the boom extends at an angle of about 45° to the horizontal. Elevation of the boom 16 in this way has several advantages, and one of these is the ability to cant the blade downwardly by pivoting the blade itself about a second pivotal axis (coincident with the longitudinal axis of the boom), so that the tip of the blade is the only portion thereof which reaches to the earth, and there functions to cut a trench or ditch. The pivotation of the blade about this second axis is effected by means of the cylinder 36 and the piston rod 34 of the boom rotating piston and cylinder subassembly 35 illustrated in FIG. 4.

At its rear end, the boom 16 is pivotally connected through the turntable assembly 18 to the blade 10. This connection is accomplished by the use of a large, vertically extending pivot bolt or shaft 80. The pivot bolt or shaft 80 projects through a diameter of boom 16, and the lower end of the bolt 80 is perceptible in FIG. 2. The pivot bolt 80 projects through a top plate 82 forming a part of the turntable assembly 18. The top plate 82 is circular in configuration and is disposed in a horizontal plane when the blade is in a horizontal attitude, as illustrated in FIG. 2.

Figure 3:
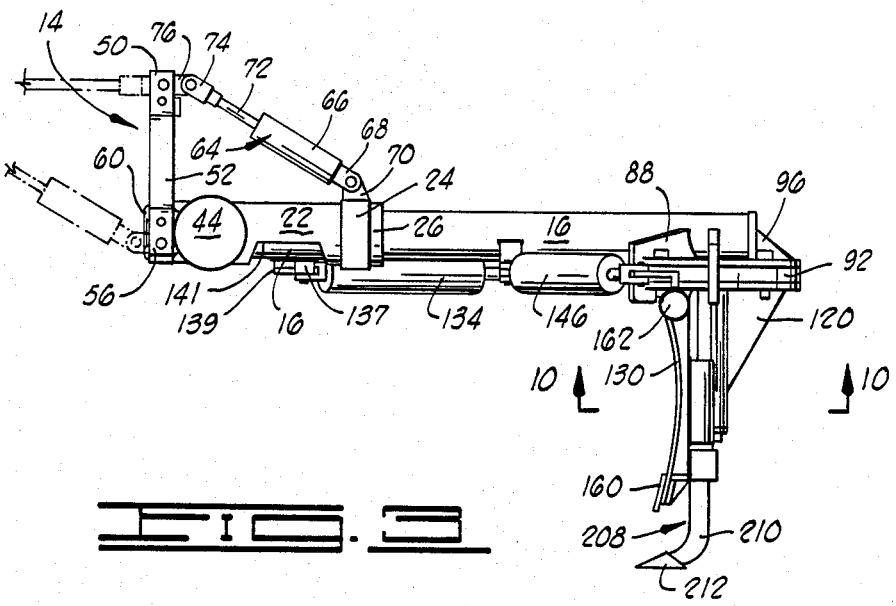
FIG. 3 is a side elevation view of the utility blade assembly.

The top plate 82 has secured to its upper side, a plurality of radially extending retainer fingers 84, 86, 88 and 90 as shown in FIGS. 1–3. These radiating retainer fingers 84, 86, 88 and 90 carry U-shaped retainer hooks at their radially outer ends. These retainer hooks project outwardly and downwardly and receive in the bight portions thereof, a lower plate 92 which is also circular in configuration and in registry with the top plate 82. It will be noted in referring to FIG. 1, that a pair of divergent, triangular shaped gusset plates 94 and 96 are also provided to connect the rear end of the boom to the top plate 82. The top plate 82 carries four retainer pin holes (not visible) near the outer periphery thereof and the retainer pin holes function, in cooperation with locking or retainer pins, to retain the blade in a particular angular position relative to the boom 16. These locking pins 98, 100, 102 and 104 are extended through the pin holes in the top plate 82 and through registering holes (not visible) in the lower plate 92.

Retained immediately beneath the lower plate 92 and around its outer periphery is an annular retainer ring 114. The annular retainer ring 114 is held in position by the bifurcated or U-shaped portions of the radially extending retainer fingers 84–90. The retainer ring 114 is secured to these retainer fingers so that the retainer ring 114 and the radially extending retainer fingers 84–90 will rotate together and concurrently with the top plate 82 to which the radially extending retainer fingers are welded or otherwise suitably secured.

For the purpose of pivotally connecting the blade to the turntable assembly 18, a plurality of large gusset plates (three being shown in the illustrated embodiment) are used for securing the lower plate 92 to a cylindrical sleeve which surrounds the pivot bolt or shaft 80. Thus, as shown in FIGS. 2 and 3, the three gusset plates 118, 120 and 122 are secured at their horizontal upper edges to a portion of the lower plate 92 which lies within the retainer ring 14, and at their vertically extending edges to an elongated, vertically extending sleeve 124 which pivotally encircles or surrounds the pivot bolt or shaft 80. The sleeve 124 is welded or otherwise suitably secured to a pair of brace plates 126 and 128 which are welded to the backside of a concavo-convex moldboard 130 forming a part of the utility blade 10.

The annular retainer ring 114 carries four locking pin holes which are positioned in the retainer ring so as to be aligned immediately beneath, and in registry with, the four retainer pin holes carried in the top plate 82 and shown as receiving the locking pins 98–104. The lower plate 92 has many pin apertures disposed adjacent its outer periphery. These are located at the same radial distance from the pivot bolt 80 as the four pin holes in the top plate 82 and the four pin holes in the retainer ring.

The effect of this arrangement is that when the utility blade 10 is pivoted about a vertical axis which is coincident with the axis of the pivot bolt 80, the lower plate 92, to which are attached the gusset plates 118, 122 and sleeve 124, will be rotated with the blade. The multiple apertures (between ten and fifteen in number) which are formed through the lower plate 92 will, in sequence, be brought into alignment with the four pin holes formed through the top plate 82 and the retainer ring 114. Thus, when the utility blade 10 has been adjusted to a desired angular position such as, for example, the angular position shown in dashed lines in FIG. 1, the blade can be retained in this position by placing the retainer pins 98–104 through the registered pin holes in the top plate 82, the lower plate 92 and the retainer ring 114.

In order to hydraulically pivot the utility blade 10 on the turntable subassembly 18, a pair of blade pivoting hydraulic piston and cylinder subassemblies are provided, and are best illustrated in FIGS. 1, 3 and 8. In FIG. 1, 2 and 3, the blade pivoting piston and cylinder subassemblies used in a first embodiment of the invention are illustrated. A different embodiment of these subassemblies is shown in FIG. 8.

In the embodiment of the invention illustrated in FIGS. 1 and 3, a first blade pivoting piston and cylinder subassembly is shown and is there designated generally by reference numeral 132. The first blade pivoting piston and cylinder subassembly 132 includes a cylinder 134 and a piston rod 136 which extends therefrom, and is connected through a clevis bracket 133 to a selected one of several axially staggered clevis plates **135*a*, 135*b* and 135*c* mounted at the upper side of the utility blade 10. The cylinder 134 is connected through a clevis bracket 137 to forward clevis plate 138. This clevis plate 138 is secured to the outer periphery of the boom 16 and projects through an enlarged slot 141 formed in the lower side of the sleeve 22 as illustrated in FIGS. 3 and 8. A second clevis plate 139 is secured to the opposite side of the boom 16 and projects downwardly out of the slot 141 as shown in FIGS. 1 and 3. The function of this second clevis plate 139** will be hereinafter explained.

Figure 9:
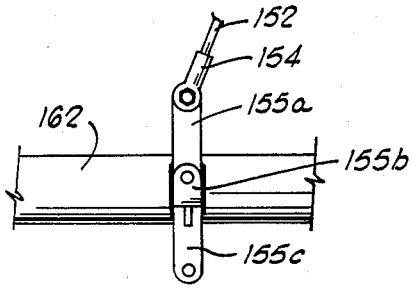
FIG. 9 depicts a multiple clevis plate bracket which can be used in one embodiment of the invention for varying the angular disposition to which the blade can be pivoted during utilization of the utility blade assembly.

There is additionally provided, a second blade pivoting piston and cylinder subassembly, designated generally by reference numeral 144. The piston and cylinder subassembly 144 includes a cylinder 146 which is illustrated as connected through a clevis bracket 148 to a clevis plate 150. The clevis plate 150 is welded to the side of the boom 16 and projects horizontally therefrom. The subassembly 144 also includes an extensible piston rod 152 which is connected through a clevis bracket 154 to a selected one of a plurality of clevis plates welded to the upper side of the utility blade 10. These clevis plates are carried on a single bracket and are denominated by reference numerals **155*a*, 155*b* and 155*c* and are best illustrated in FIG. 9**.

The manner in which the piston rod 152 is selectively connected to one of the clevis plates **155*a*, 155*b* and 155*c* secured to the top of the utility blade 10 is similar to the manner in which the piston rod 136 is selectively connected to one of several clevis plates 135*a*, 135*b* and 135*c* secured to the top of the utility blade on the opposite side of the turntable 18. The manner in which the blade pivoting piston and cylinder subassemblies 132 and 144 cooperate to pivot the blade 10 relative to an axis of pivotation extending through the turntable subassembly 18** will be hereinafter explained in greater detail.

The utility blade, which has been generally designated by reference numeral 10, includes, in addition to the concavo-convex moldboard 130, a cutting plate 160 illustrated in FIGS. 3 and 4. An elongated, tubular, reinforcing member 162 is secured to the upper edge of the moldboard and extends from one end thereof to the other so as to span substantially the entire transverse width of the cutting blade 10. Elongated tubular member 162 is welded to the upper ends of a plurality of bracing rods 164–172 which are provided at the backside of the moldboard.

These bracing rods project vertically downwardly from the tubular member 162 to a transversely extending reinforcing plate 174. The reinforcing plate 174 projects from the rear side of the moldboard at about the location where the cutting plate 160 is joined thereto, and the reinforcing plate extends parallel to the tubular member 162. A backup reinforcing plate 176 is abutted flatly against the moldboard at its lower edge, and is secured in position by securement to the backside of the moldboard, and by securement to a plurality of triangular gusset plates 178–196, as illustrated in FIG. 2.

In the embodiment of the invention illustrated in FIGS. 1–5, a ditching extension subassembly is illustrated, and is designated generally by reference numeral 200. The ditching extension subassembly 200 includes a slightly arcuate ditching plate 202 which is bolted by bolts 204, or is otherwise secured, to the bracing rod carried at one end of the moldboard 130. The manner in which the ditching subassembly 200 is used will be subsequently explained.

The embodiment of the invention illustrated in FIGS. 1–5 also depicts a ripper tooth or scarifying tine subassembly 208 which can be optionally mounted near one end of the moldboard for ripping the earth at that location. The ripper tooth subassembly 208 can be used in aid of the ditching subassembly, or can be used separately for forming a very narrow trench or ripping a deep groove in the earth. The ripper tooth subassembly 208 includes an elongated generally L-shaped tooth shank 210 which carries a pointed overcap 212 at the lower, forward end thereof. The tooth shank 210 is slidably mounted in a sleeve 213 carried at the rear side of the moldboard 130, and having a plurality of bolt holes therethrough which can be registered with bolt holes formed in tooth shank to set the particular depth at which the ripper tooth overcap 212 will travel through the ground.

Figure 6:
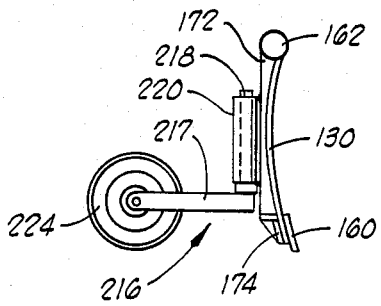
FIG. 6 illustrates the manner in which one of a pair of gauge wheels can be mounted to the rear side of the utility blade assembly.

FIG. 6 of the drawings illustrates another possible manner of utilizing the utility blade of the invention. There is here illustrated a gauge wheel subassembly, designated generally by reference numeral 216, which is mounted on the rear side of the moldboard 130. The gauge wheel subassembly 216 includes an elongated, horizontally extending shaft 217 which is secured to the lower end of a vertically extending mounting rod 218 which is swively or pivotally received within a sleeve 220 carried on the rear side of the moldboard. Two sleeves of this type are provided for mounting a pair of horizontally spaced gauge wheels, and such sleeves are shown in FIG. 2 of the drawings where the second sleeve is illustrated and is denominated by reference numeral 222. At the rear end of the horizontally extending shaft 217, a gauge wheel 224 is rotatably mounted. As will be subsequently explained, the gauge wheel 224 cooperates with another identical gauge wheel located at the opposite side of the utility blade and functions to control the depth at which the blade 160 will run in a plowing or earth turning operation.

A portion of an alternate embodiment of the invention is illustrated in FIG. 8. In this figure of the drawings, identical reference numerals have been used to identify identical structural parts and subassemblies when such identity exists. The structures used in this embodiment of the invention which differ from those employed in the embodiments shown in FIGS. 1–7 carry different reference numerals.

As shown in FIG. 8, the boom 16 projects through the sleeve 22 in the same fashion as previously described. The sleeve 22 has in the lower side thereof, the elongated generally rectangular slot 141 which has a circumferential dimension around the sleeve 22 which is of about 120°, or one third of the circumference of the sleeve. This affords adequate accommodation of the rotation of the boom 16 at those times when it is desired to cause the rotation of the boom in a manner and for the reasons hereinafter described.

Secured to the lower side of the boom 16 at the lowermost points therealong at a time when the utility blade 10 extends horizontally are a pair of double clevis plates. These clevis plates are here denominated as a forward double clevis plate 230 which carries holes 232 for clevis pins at its opposite ends, and a rear double clevis plate 234 which carries clevis pin holes 236 at its opposite ends.

In FIG. 8, a piston rod 238 which projects from one end of a cylinder 240 is illustrated. The cylinder 240 is shown as carrying a clevis bracket 239 connected by a clevis pin to one end of the forward clevis plate 230. The piston rod 238, along with the cylinder 240, is a part of a blade rotating piston and cylinder subassembly 242 which corresponds generally in its function to the piston and cylinder subassembly 144 illustrated in FIG. 1.

At the other side of the boom 16, a piston rod 244 is reciprocably extensible from a cylinder 246, and is connected through a clevis bracket 247 to the rear clevis plate 234 by means of a clevis pin. The piston rod 244 and cylinder 246 form a part of a blade pivoting piston and cylinder subassembly 248. The blade pivoting piston and cylinder subassembly 248 corresponds in overall and general function to the piston and cylinder subassembly 132 illustrated in FIG. 1.

Operation

In utilizing the utility blade assembly of the invention, the operator of the tractor has the usual controls attendant to a three-point hitch connection which is typical of agricultural and small construction tractors. In such three-point hitch connections, there are generally a pair of outer links or connections available, and these are at a relatively lower horizontal level, as compared to a central link or connection which is disposed substantially midway between the outer link connections, and at a substantially elevated level in relation to the outer links. As in the general operation of a three-point hitch connection to any type of tilling or earth working implement connected to the tractor, the hydraulic system of the tractor permits the attached implement to be elevated and lowered, or permits the implement to be fixed in a selected intermediate position. This occurs as a result of the elevation and lowering of the control arms or rods which extend to the outer links, and the concurrent pivotation of a central control rod which extends to the upper central link of the three-point hitch connection 14.

In addition to this movement, the utility blade 10 of the present invention can be placed in a variety of attitudes for ditching, for smoothing, for ripping or for running at a controlled depth through the soil.

One of the principle controls for the utility blade assembly of the invention is the control afforded by the boom lifting piston and subassembly 64. Using this subassembly, the operator of the tractor can cause the piston rod 72 thereof to be retracted within the cylinder 66. The result is that the elongated boom 16 is pivoted upwardly as the sleeve 22 through which it extends is caused to pivot upwardly. Pivotation occurs about a horizontal axis which is coincident with the axes of the tubular, transversely extending pivot arms 40 and 42.

These arms can rotate in the collars 44 and 46 as the sleeve 22 and the boom 16 are pivoted upwardly. The boom 16 is prevented from undergoing axial movement relative to the sleeve 22 by the rear and forward retainer rings 26 and 28, respectively. The boom lifting piston and cylinder subassembly 64 enables the rear end of the boom 16 to be elevated an amount which is substantially equivalent to the boom being angled upwardly at an angle of 45° with respect to the horizontal.

Figure 7:
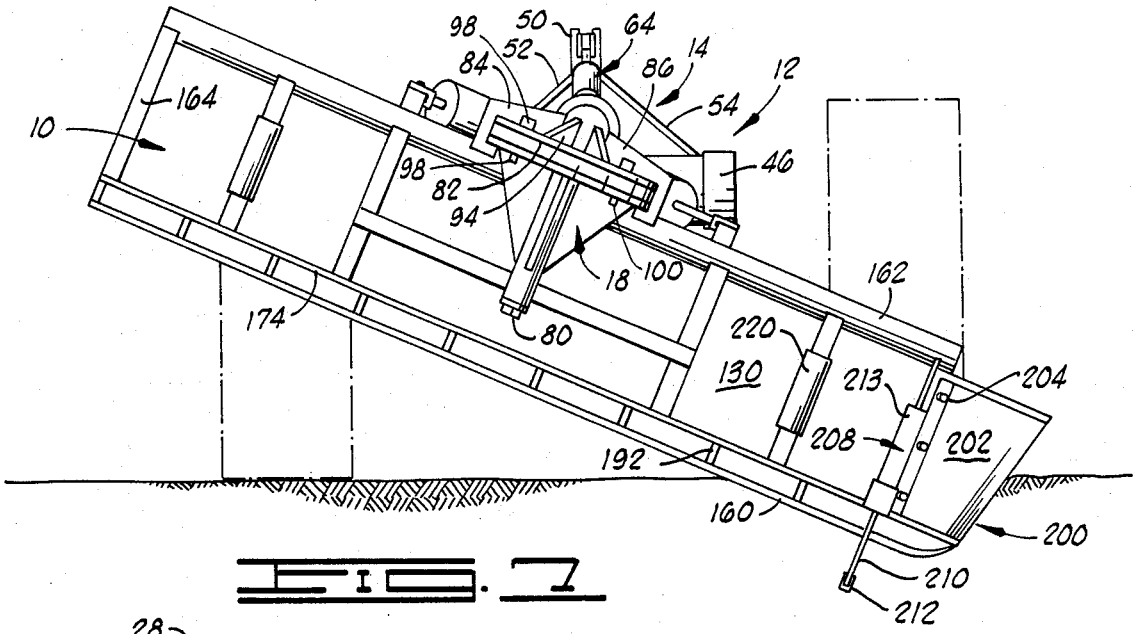
FIG. 7 is a rear elevation view of the utility blade in one of its operating positions in which the blade is being utilized for digging a round bottomed trench or ditch.

In addition to the described upward pivotation of the boom 16, the boom can be caused to undergo rotation about its longitudinal axis. This movement of the boom is effected by means of the boom rotating piston and cylinder subassembly 35 which includes the cylinder 36 and the piston rod 34 as illustrated in FIG. 4. Extension of the piston rod 34 will cause the boom 16 to be rotated about its longitudinal axis in a counterclockwise direction, as it is viewed in FIG. 4, or, stated differently, will cause the right end of the utility blade 10, as it is viewed in FIG. 1, to be dipped downwardly. This is an attitude that is often desired for a trenching or ditching operation where the ditching extension subassembly 200 is utilized for digging a trench or ditch. The rounded lower corner of the ditching plate 202 permits a round bottom trench to be formed when the blade is in the described attitude. The attitude of the blade at a time when the boom lifting piston and cylinder subassembly 64 has been lifted to its maximum elevation, and the utility blade has been dipped downwardly by rotation of the boom 16 about its longitudinal axis to the maximum extent within the capability of the cylinder 36 and piston rod 34 is illustrated in FIG. 7 of the drawings.

In addition to the lifting upwardly and the rotation about the longitudinal axis of the boom which can be effected through the use of the hydraulic subassemblies thus far described, the utility blade 10 can be pivoted on the turntable subassembly 18 in several ways. If a piston and cylinder subassembly on the left side of the boom (as it is viewed from above as shown in FIG. 1) is attached in substantially the same orientation with respect to the boom and the blade, as is the piston and cylinder subassembly 132 shown on the right side of the boom, and is of equal size to that piston and cylinder subassembly, then the moldboard 130 and cutting plate 160 can be pivoted through an angle of about 40° with respect to the longitudinal axis of the boom, and on either side of that axis. In other words, the position illustrated in dashed lines in FIG. 1 will represent one extreme of movement of the moldboard and cutting blade when the piston and cylinder subassemblies are precisely equal in length, and are the same in the distance separating points of attachment of the subassemblies to the blade and to the boom 16.

This attachment of a piston and cylinder subassembly in the same orientation as the orientation in which the piston and cylinder subassembly 132 is attached between the boom and blade is accomplished by attaching the larger cylinder of such a subassembly to the clevis plate 139 (see FIG. 1) carried by the boom on the opposite side thereof from the clevis plate 138. The piston rod of this piston and cylinder subassembly would remain pinned to a selected one of the clevis plates **155*a*, 155*b* and 155*c*. When a piston and cylinder subassembly is so attached and oriented, it will be perceived that the piston rod thereof must be extended substantially the same distance from its respective cylinder as the piston rod 136 is extended from the cylinder 134 at a time when the utility blade 10 projects at a right angle to the path of the travel of the tractor. When this arrangement of equal size and same orientation characterizes the blade pivoting piston and cylinder subassemblies, then the blade can be pivoted between positions corresponding to the dashed line positions shown in FIG. 1 on opposite sides of the boom 16**, so that the total arc through which the utility blade is pivoted is about 80° (40° on each side of center alignment).

It will be noted that because of the relatively large circumferential dimension of the slot 131 formed through the underside of the sleeve 22, the attachment of the cylinders of the respective blade pivoting piston and cylinder subassemblies to the clevis plates carried on the boom, and projecting through this opening, will not be interfered with as the boom 16 is caused to undergo rotation when the piston rod 34 is reciprocated into and out of the cylinder 36.

When the arrangement of the blade pivoting piston and cylinder subassemblies 132 and 144 is that which is illustrated in FIG. 1, however, it is then possible through the concurrent use of the two blade pivoting hydraulic piston and cylinder subassemblies to pivot the moldboard 130 and cutting blade 160 through about 120° to an extreme position in which the utility blade extends sharply forward. In FIG. 1, the piston and cylinder subassembly 144 is shown in an alternate position where the piston rod 148 is connected by a suitable clevis pin to the clevis plate 150 which is positioned rearwardly on the boom 16 from the sleeve 22.

It will be perceived that when the system is constructed as shown in FIG. 1, then in order to pivot through 120° to one side of the longitudinal axis of the boom 16, it is necessary to use the two different sizes of piston and cylinder subassemblies represented by those as shown at 132 and 144 in FIG. 1, and related in their arrangements as shown in FIG. 1. If, on the other hand, the alternate embodiment of the invention shown in FIG. 8 is employed, the same size piston and cylinder subassembly can be used on each of the two opposite sides of the boom 16 in order to achieve the pivotation of the blade through about 40° to either side of the longitudinal axis of the boom, or, if desired, to achieve an extreme pivotation through an angle of 120° on one side of the boom alone. In this latter case, the arrangement shown in FIG. 8 of the drawings is utilized, and the piston and cylinder arrangement which is on the left side of the boom 16 is utilized. The cylinder 242 of this subassembly is connected to the forward clevis bracket 230, and the piston rod extends, and be connected to, the clevis plate **155*b*. The piston and cylinder subassembly 248 on the other side of the boom 16, however, has its cylinder connected to the rear clevis plate 234, and its piston rod connected to the clevis plate 135*a*. Both clevis plates 230 and 234 are secured to the underside of the boom 16 and project downwardly and outwardly through the slot 141 formed in the sleeve 22**.

Figure 5:
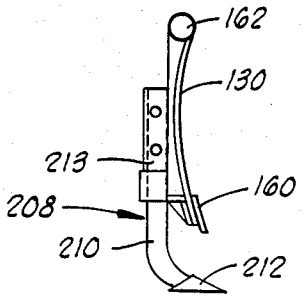
FIG. 5 depicts the manner in which a ripper tine is mounted at one side of the utility blade, showing the utility blade and the ripper tine in side elevation.

One or more of the scarifying or ripper teeth of the type shown in FIGS. 2, 3 and 5 of the drawings can be utilized for scarifying the earth or ripping narrow trenches. The depth at which such a tooth will run in the earth can be adjusted by adjusting the extent to which the shaft 210 extends upwardly through its respective receiving sleeve.

To control the depth at which the cutting blade 160 runs in the earth, a pair of gauge wheels 224 are provided as shown in FIG. 6. The distance which the gauge wheels 224 are set above the lower edge of the cutting blade 160 enables the gauge wheels to be used to control the depth at which the cutting blade runs in the earth.

Although certain preferred embodiments of the invention have been herein illustrated and described in order that the principles of the invention can be easily perceived and followed, it will be understood that various changes in the precise structure depicted and described can be effected without departure from these principles, and are intended to be circumscribed by the spirit and scope of the invention.

What is claimed is:

1. A utility blade assembly comprising:
- a three-point hitch connection for connection of an earth moving blade to a tractor, and including:
  - a central, upper one point connecting structure; and
  - a pair of outer, lower connecting structures;
- an elongated, generally horizontally extending boom having a forward end and a rear end;
- a sleeve rotatably receiving the forward end portion of said boom for rotation of the boom about its longitudinal axis within said sleeve, said sleeve having a forward end and a rear end;
- a pair of aligned, horizontally extending transverse pivot arms secured to, and extending from, opposite sides of said sleeve;
- means for connecting said pivot arms to the two outer, lower connecting structures of said three-point hitch connection for pivotation of the pivot arms about a horizontal axis extending normal to the longitudinal axis of said boom;
- a boom lifting piston and cylinder subassembly connected between the rear end of said sleeve and said central upper connecting structure of said three-point hitch connection for elevating the sleeve and boom when said boom lifting piston and cylinder subassembly is actuated;
- means for selectively rotating said boom within said sleeve and about the longitudinal axis of the boom;
- a turntable subassembly carried on the rear end of said elongated boom and including an upper plate fixed to said boom and a lower plate rotatable relative to said upper plate;
- an elongated utility blade secured to said lower plate and rotatable with said lower plate relative to said upper plate; and
- means connected between said boom and said utility blade to pivot said blade and said lower plate about the axis of rotation of said lower plate on said upper plate.

2. A utility blade assembly as defined in claim 1 wherein said means for rotating the boom within said sleeve comprises a piston and cylinder subassembly connected between the outer periphery of the boom and said three-point hitch connection.

3. A utility blade assembly as defined in claim 1 wherein said means for pivoting the blade and lower plate about the axis of rotation of said lower plate on said upper plate comprises:
- a first blade pivoting piston and cylinder subassembly connected between one side of the boom and a first point on said blade between the center of the blade and one of the ends of the blade; and
- a second blade pivoting piston and cylinder subassembly connected between said boom on the opposite side thereof from said first blade pivoting piston and cylinder subassembly and a second point on said blade which is on the opposite side of the center of the blade from said first point.

4. A utility blade assembly as defined in claim 1 and further characterized as including means for fixing said upper plate to said lower plate to prevent relative movement therebetween.

5. A utility blade assembly as defined in claim 1 as including a ditching extension subassembly secured to one end of said blade and including a ditching plate extending outwardly and forwardly from said blade.

6. A utility blade assembly as defined in claim 5 wherein said ditching plate has a rounded lower, outer corner facilitating formation of a round bottomed trench.

7. A utility blade assembly as defined in claim 1 and further characterized as including:
- a ripper tooth adjustably and removably attached to the rear side of said blade; and
- gauge wheel means mounted on the rear side of said blade and including a gauge wheel adjustably supported for vertical adjustment relative to the cutting edge of the blade.

8. A utility blade assembly as defined in claim 3 and further characterized as including:
- a first pair of spaced clevis plates longitudinally spaced from each other on said one side of said boom to facilitate selective securement of one end of said first blade pivoting piston and cylinder subassembly to said boom; and
- a second pair of spaced clevis plates secured to said boom at longitudinally spaced points on the opposite side of said boom from said first pair of clevis plates to facilitate selective securement of one end of said second blade pivoting piston and cylinder subassemblies to said boom.

9. A utility blade assembly as defined in claim 1 wherein said turntable assembly further comprises:
- a pivot bolt extending substantially normal to the longitudinal axis of said boom, and extending through said boom, said upper plate and said lower plate; and
- a plurality of radiating retainer fingers secured to the upper side of said upper plate projecting outwardly and downwardly around said lower plate to pivotally support the lower plate for pivotation about said pivot bolt.

10. A utility blade assembly as defined in claim 8 wherein said means for rotating the boom within said sleeve comprises a piston and cylinder subassembly connected between the outer periphery of the boom and said three-point hitch connection.

11. A utility blade assembly comprising:
- hitch means for connecting a blade-carrying boom to a tractor;
- an elongated boom having an inner first end pivotally and rotatably connected to said hitch means for pivotation about a horizontal axis extending normal to the longitudinal axis of the boom, and for rotation about said longitudinal axis, said boom further including an outer second end;
- an elongated blade pivotally connected to the outer second end of said boom for pivotation about a pivotal axis extending perpendicular to the longitudinal axis of said boom and extending parallel to the plane of said horizontal axis of pivotation of said boom;
- first hydraulic piston and cylinder means connected between said hitch means and said elongated boom for pivoting said boom about said horizontal axis of pivotation to elevate and lower the second, outer end of said boom and the elongated blade carried thereon;

second hydraulic piston and cylinder means connected between said hitch means and said elongated boom for rotating said boom about its longitudinal axis without movement of said hitch means;

third hydraulic piston and cylinder means for pivoting said blade about said axis of pivotation extending perpendicular to the longitudinal axis of the boom to thereby draw one end or the other end of said elongated blade relatively closer to said hitch means.

12. A utility blade assembly as defined in claim 11 wherein said hitch means comprises:

a pair of rigid, diagonal braces having upper ends and lower ends and extending downwardly and outwardly from an upper, central point of convergence;

a top link carried at the upper ends of said diagonal braces; and a pair of horizontally spaced lower and outer hitch links, each of said lower and outer hitch links being connected to the lower end of one of said diagonal braces.

13. A utility blade assembly as defined in claim 11 and further characterized as including:

a cylindrical sleeve receiving the first inner end of said boom therethrough for rotation of the boom in the sleeve about the longitudinal axis of the boom; and means for pivotally connecting said sleeve to said hitch means for pivotation about a horizontal axis.

14. A utility blade assembly as defined in claim 11 and further characterized as including means for selectively locking said elongated blade against pivotation on the outer second end of said boom.

15. A utility blade assembly as defined in claim 11 wherein said third hydraulic piston and cylinder means comprises:

a first blade pivoting piston and cylinder subassembly extending between a selected location on one side of the boom and a first point on the blade;

a second blade pivoting piston and cylinder subassembly extending between a selected location on the opposite side of said boom from said one side, and a second point on said blade spaced longitudinally therealong from said first point on the blade.

16. A utility blade assembly as defined in claim 13 wherein said means for pivotally connecting said sleeve to said hitch means comprises a pair of elongated pivot arms extending from opposite sides of said sleeve.

17. A utility blade assembly as defined in claim 11 and further characterized as including a ditching extension subassembly detachably connected to one end of said blade.

18. A utility blade assembly as defined in claim 11 and further characterized as including a ripper tooth subassembly secured to the back side of said blade.

19. A utility blade assembly as defined in claim 18 and further characterized as including gauge wheel means secured to said blade and functioning to control the depth to which said ripper tooth subassembly penetrates the earth.

20. A utility blade assembly as defined in claim 16 wherein said third hydraulic piston and cylinder means comprises:

a first blade pivoting piston and cylinder subassembly extending between a selected location on one side of the boom and a first point on the blade; and a second blade pivoting piston and cylinder subassembly extending between a selected location on the opposite side of said boom from said one side, and a second point of said blade spaced longitudinally therealong from said first point on the blade.

21. A utility blade assembly comprising:

hitch means adapted for connecting the blade assembly to a tractor through a three-point hitch connection;

an elongated boom having a forward first end pivotally connected to said hitch means for pivotation about a horizontal axis and having a rearward second end;

an elongated blade pivotally connected to the rearward second end of said boom for pivotation about an axis extending perpendicular to the axis of the boom;

means for elevating the rearward end of said boom and said blade by pivotation of said boom about the horizontal pivotal axis;

a ditching extension subassembly carried on one end of said elongated blade and including a ditching plate extending outwardly and forwardly from said one end of said elongated blade;

a right hydraulic piston and cylinder interconnected between one side of said boom at a location intermediate the ends of the boom, and a point along the elongated blade between the pivotal axis of the blade on the boom and said one end of said elongated blade; and a left hydraulic piston and cylinder interconnected between the opposite side of said boom from the location of said right hydraulic piston and cylinder at a location intermediate the ends of said boom, and a point along said elongated blade between the pivotal axis of the blade on the boom and said other end of said elongated blade; and said right and left hydraulic pistons and cylinders being connected between the blade and boom so that when said blade is loaded by movement through the earth so as to place the piston rod of one of the right and left piston and cylinders in compression, the piston rod of the other of said right and left piston and cylinders is placed in tension when said blade is, but for said right and left cylinder pistons and cylinders, freely pivotable about said axis of pivotation of the blade on the boom.

22. A utility blade assembly as defined in claim 21 and further characterized as including means for locking said blade in a selected fixed position relative to said boom.

23. A utility blade assembly as defined in claim 21 and further including blade connecting means for pivotally connecting said elongated blade to said second rear end of said boom, said blade connecting means comprising:

an upper plate positioned adjacent and beneath the rear second end of said boom and extending in a plane extending substantially parallel to the longitudinal axis of the boom;

a lower plate positioned adjacent and beneath said upper plate and positioned in a plane extending substantially parallel to said upper plate;

a pivot bolt extending through said boom and through said upper and lower plates coincident with a pivotal axis extending normal to the longitudinal axis of said boom; and a plurality of radiating retainer fingers secured to the upper side of said upper plate and projecting outwardly and downwardly around and beneath said lower plate; and a retainer ring secured within said retainer fingers and slidably bearing against the under side of said lower plate.

24. A utility blade assembly comprising:

hitch means adapted for connecting the blade assembly to a tractor through a three-point hitch connection;

an elongated boom having a forward first end pivotally connected to said hitch means for pivotation about a horizontal axis and for rotation about the longitudinal axis of said elongated boom, said boom further having a rearward second end;

an elongated utility blade pivotally connected to the rearward second end of said boom for said pivotation about an axis expending perpendicular to the longitudinal axis of said boom;

at least one ripper tooth subassembly adjustably and removably secured to the rear side of the elongated blade and projecting downwardly below the cutting edge carried at the lower side of said blade; and at least one gauge wheel subassembly adjustably mounted on the rear side of said elongated blade for adjustable movement upwardly and downwardly on the blade for controlling the depth in the earth to which said ripper tooth subassembly will extend when said gauge wheels are so adjusted and said ripper tooth subassembly is used for ripping the earth.

* * * * *